US009802434B2

(12) United States Patent
Nagase et al.

(10) Patent No.: US 9,802,434 B2
(45) Date of Patent: Oct. 31, 2017

(54) RECORDING MEDIUM WITH INCREASED SCRATCH AND WATER RESISTANCE

(71) Applicant: CANON KABUSHIKI KAISHA, Tokyo (JP)

(72) Inventors: Yoshiyuki Nagase, Kawasaki (JP); Takeshi Ota, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/069,687

(22) Filed: Mar. 14, 2016

(65) Prior Publication Data

US 2016/0271986 A1 Sep. 22, 2016

(30) Foreign Application Priority Data

Mar. 16, 2015 (JP) ..... 2015-052528
Mar. 16, 2015 (JP) ..... 2015-052529

(51) Int. Cl.
*B41M 5/00* (2006.01)
*B41M 5/52* (2006.01)
*B41M 5/50* (2006.01)

(52) U.S. Cl.
CPC ..... *B41M 5/5218* (2013.01); *B41M 5/50* (2013.01); *B41M 5/502* (2013.01); *B41M 5/52* (2013.01); *B41M 5/5254* (2013.01); *B41M 5/5272* (2013.01); *B41M 5/5281* (2013.01)

(58) Field of Classification Search
CPC .... B41M 5/50; B41M 5/5218; B41M 5/5245; B41M 5/5254
See application file for complete search history.

(56) References Cited

U.S. PATENT DOCUMENTS

2002/0097290 A1* 7/2002 Koitabashi ..... B41J 2/04533 347/16
2003/0021964 A1* 1/2003 Kaneko ..... B41M 5/52 428/195.1
2004/0152819 A1* 8/2004 Cuch ..... B41M 5/506 524/430
2004/0191433 A1* 9/2004 Sakaguchi ..... B41M 5/52 428/32.34

FOREIGN PATENT DOCUMENTS

JP H10272832 A 10/1998
JP 2000318304 A 11/2000
JP 2001001629 A 1/2001
JP 2001105717 A 4/2001
JP 2002052812 A 2/2002

* cited by examiner

*Primary Examiner* — Betelhem Shewareged
(74) *Attorney, Agent, or Firm* — Canon U.S.A., Inc. IP Division

(57) ABSTRACT

A recording medium includes a substrate and an ink-receiving layer, wherein the ink-receiving layer contains an inorganic particle and a binder, and does not contain any water-soluble resin or contains a water-soluble resin such that a ratio of the content of the water-soluble resin to the content of the binder in the ink-receiving layer is 20% by mass or less, the binder contains at least one component selected from the group consisting of acrylic resins, polycarbonate-modified urethane resins, and polyether-modified urethane resins, and, for the recording medium, a ratio of a total pore volume in a pore radius range of 7 nm or more and 20 nm or less to a total pore volume in a pore radius range of 0 nm or more and 20 nm or less is 25% by volume or less.

13 Claims, No Drawings

RECORDING MEDIUM WITH INCREASED SCRATCH AND WATER RESISTANCE

BACKGROUND

Field of the Disclosure

The present disclosure relates to a recording medium.

Description of the Related Art

Some recorded articles obtained by recording images on recording media by the inkjet image recording method have come to be put up outdoors. Such a recording medium for outdoor display use needs to have ink absorbency equivalent to that of existing recording media and to include an ink-receiving layer having higher scratch resistance and water resistance than existing recording media.

There is a known recording medium including an ink-receiving layer formed so as to contain a water-insoluble resin such as an acrylic resin or a urethane resin in order to improve the scratch resistance or water resistance of the ink-receiving layer. According to Japanese Patent Laid-Open No. 2000-318304, a recording medium includes an ink-receiving layer formed so as to contain an acrylic resin emulsion, polyvinyl alcohol, silica, and a melamine-based cross-linking agent in specific ratios, to thereby achieve an improvement in the water resistance. According to Japanese Patent Laid-Open No. 2002-052812, a recording medium includes an ink-receiving layer formed so as to contain silica, an acrylic resin and/or a urethane resin, and a water-soluble aluminum salt, to thereby achieve improvements in the water resistance and the scratch resistance. According to Japanese Patent Laid-Open No. 2001-001629, a recording medium includes an ink-receiving layer formed so as to contain silica and a water-insoluble and water-dispersible cationic acrylic resin, to thereby achieve an improvement in the water resistance. According to Japanese Patent Laid-Open No. 2001-105717, a recording medium includes an ink-receiving layer formed so as to contain a water-insoluble resin, a pigment, a water-soluble cationic resin, and a surfactant, to thereby achieve improvements in the ink absorbency, the water resistance, and the surface strength. According to Japanese Patent Laid-Open No. 10-272832, a recording medium includes a resin film and an ink-receiving layer formed on the resin film so as to contain amorphous silica, a water-insoluble resin, and a water-soluble resin, to thereby achieve improvements in the water resistance and the strength.

SUMMARY

The present disclosure provides a recording medium that is excellent in terms of ink absorbency, scratch resistance, and water resistance.

The present disclosure provides such recording media as described below.

An embodiment of the present disclosure provides a recording medium including a substrate and an ink-receiving layer, wherein the ink-receiving layer contains an inorganic particle and a binder, and does not contain any water-soluble resin or contains a water-soluble resin such that a ratio of a content of the water-soluble resin to a content of the binder in the ink-receiving layer is 20% by mass or less, the binder contains at least one component selected from the group consisting of acrylic resins, polycarbonate-modified urethane resins, and polyether-modified urethane resins, and, for the recording medium, a ratio of a total pore volume in a pore radius range of 7 nm or more and 20 nm or less to a total pore volume in a pore radius range of 0 nm or more and 20 nm or less is 25% by volume or less.

The present disclosure provides a recording medium exhibiting excellent ink absorbency, scratch resistance, and water resistance.

Further features of the present disclosure will become apparent from the following description of exemplary embodiments.

DESCRIPTION OF THE EMBODIMENTS

The inventors of the present disclosure studied recording media described in Japanese Patent Laid-Open Nos. 2000-318304, 2002-052812, 2001-001629, 2001-105717, and 10-272832 and have found that the ink-receiving layers have somewhat improved but still insufficient scratch resistance and water resistance.

Hereinafter, the present disclosure will be described further in detail with reference to embodiments.

The inventors of the present disclosure studied how to provide a recording medium having such high water resistance that it can be put up outdoors. As a result, the inventors have found that, for the ink-receiving layer, the content of a hydrophilic resin, which is commonly used as the binder, needs to be reduced (the ink-receiving layer does not contain any water-soluble resin or contains a water-soluble resin such that the ratio of the water-soluble resin content to the binder content in the ink-receiving layer is 20% by mass or less); instead, the ink-receiving layer needs to contain a highly hydrophobic and less hydrolyzable binder, specifically at least one selected from acrylic resins, polycarbonate-modified urethane resins, and polyether-modified urethane resins. The ink-receiving layer in Japanese Patent Laid-Open No. 2000-318304 has a high content of a water-soluble resin, polyvinyl alcohol (PVA), which results in insufficient water resistance. When a polyester resin or a polyester-modified urethane resin, each of which has high hydrophobicity but easily hydrolyzes, is used as a binder, the water resistance lowers.

On the other hand, when an acrylic resin, a polycarbonate-modified urethane resin, or a polyether-modified urethane resin is used as the binder, the capability of binding the inorganic particle becomes insufficient, sometimes resulting in a recording medium including an ink-receiving layer that is susceptible to scratches, that is, has low scratch resistance, or has low ink absorbency. The inventors of the present disclosure studied the mechanism by which such a disadvantage is caused and has found that the hydrophobic binder such as an acrylic resin, a polycarbonate-modified urethane resin, or a polyether-modified urethane resin is absorbed by the inorganic particle itself and no longer functions as a binder. More specifically, a phenomenon described below probably occurs.

Primary particles of an inorganic particle aggregate to form secondary particles, which are composed of a large number of primary particles. These secondary particles are bound together with a binder, to thereby form the ink-receiving layer. The above-described phenomenon of absorption of a hydrophobic binder is specifically a phenomenon in which the hydrophobic binder is absorbed into pores between primary particles of the inorganic particle. This results in reduction in the amount of the binder that binds the secondary particles together. Thus, the secondary particles tend to separate from each other upon application of an external force onto the ink-receiving layer, hence low scratch resistance. The recording medium exhibits ink absorbency in a manner that pores between the primary particles of the inorganic particle and pores between the secondary particles (these pores are larger than the pores of the primary particles) absorb the liquid content of the ink. However, as a result of the above-described phenomenon of absorption of a hydrophobic binder, the pores between the primary particles of the inorganic particle are filled with the hydrophobic binder. Thus, the recording medium also has low ink absorbency.

Studies performed by the inventors of the present disclosure have revealed that, in general, the size of pores (pore radius determined by pore distribution measurement) between primary particles of an inorganic particle, the pores contributing to absorption of the hydrophobic binder, is 7 nm or more. In other words, when the size of pores between primary particles of an inorganic particle is less than 7 nm, the pores are small and tend not to absorb the hydrophobic binder. Accordingly, the inventors consider that, the lower the ratio of pores (contributing to absorption of the hydrophobic binder) between primary particles of an inorganic particle, that is, the ratio of the pores having a pore radius of 7 nm or more, the more suppressed the occurrence of the above-described phenomenon of absorption of the hydrophobic binder, which results in enhanced scratch resistance and ink absorbency. Thus, the inventors have accomplished the present disclosure. If the size of target pores is simply defined such that the pore radius determined by pore distribution measurement is 7 nm or more, these pores also include the above-described pores between secondary particles (these pores are larger than pores between primary particles). For this reason, in order to count only pores between the primary particles of an inorganic particle with excluding pores between the secondary particles, which do not contribute to absorption of the hydrophobic binder, for convenience, the upper limit of the target pore radius during pore distribution measurement is defined as 20 nm. This upper limit value of 20 nm has been empirically determined by the inventors of the present disclosure through studies on various inorganic particles. The inventors have demonstrated that setting the upper limit to this value enables, for ordinary inorganic particles, counting only pores between primary particles of inorganic particles.

In an embodiment of the present disclosure, the "ratio of pores (contributing to absorption of the hydrophobic binder) between primary particles of an inorganic particle, that is, the ratio of the pores having a pore radius of 7 nm or more" is defined as (total pore volume in the pore radius range of 7 nm or more and 20 nm or less in recording medium)/(total pore volume in the pore radius range of 0 nm or more and 20 nm or less in recording medium)×100 (vol %). The inventors studied various recording media and have found the following findings: by producing a recording medium such that the ratio of the total pore volume in the pore radius range of 7 nm or more and 20 nm or less to the total pore volume in the pore radius range of 0 nm or more and 20 nm or less is 25% by volume or less, high levels of ink absorbency, scratch resistance, and water resistance are achieved.

By the above-described mechanisms, the features synergistically provide advantages of embodiments that are achievements of high levels of ink absorbency, scratch resistance, and water resistance.

Recording Medium

A recording medium according to an embodiment includes a substrate and at least one ink-receiving layer. The recording medium according to the embodiment can be an inkjet recording medium used for the inkjet recording method.

Surface Roughness of Recording Medium

The surface roughness of the recording medium may be appropriately adjusted in accordance with the target glossiness of the recording medium. Usable conditions for some examples will be described below. Examples of the method for adjusting the surface roughness of the recording medium include a method of pressing a roller having specific irregularities onto a surface of a substrate and coating the surface with a coating liquid for forming the ink-receiving layer (hereafter, referred to as an "ink-receiving-layer coating liquid"); a method of pressing a roller having specific irregularities onto a surface of the recording medium; a method of changing the size of the inorganic particle contained in the ink-receiving layer to thereby adjust the surface roughness; and a method of forming another layer containing an inorganic particle on the ink-receiving layer and changing the size of the inorganic particle in the layer or the coverage of the layer to thereby adjust the surface roughness.

(1) Glossy Paper Sheet

When the recording medium is produced as a glossy paper sheet, the surface of the recording medium preferably has an arithmetic average roughness Ra (defined by JIS B 0601: 2001) of 0.13 μm or less, more preferably 0.05 μm or more, particularly preferably 0.10 μm or more.

(2) Semi-Glossy Paper Sheet

When the recording medium is produced as a semi-glossy paper sheet, the surface of the recording medium preferably has an arithmetic average roughness Ra (defined by JIS B 0601: 2001) of 5.0 μm or less, more preferably 0.1 μm or more, particularly preferably 0.50 μm or more.

(3) Matte Paper Sheet

When the recording medium is produced as a matte paper sheet, the surface of the recording medium preferably has an arithmetic average roughness Ra (defined by JIS B 0601: 2001) of 1.0 μm or more and 10.0 μm or less, more preferably 1.0 μm or more and 5.0 μm or less. When the recording medium is produced as a matte paper sheet, the surface of the recording medium preferably has a root mean square slope RΔq of roughness profile elements (defined by JIS B 0601: 2001) of 0.3 μm or more, more preferably 0.5 μm or more.

Hereinafter, components of a recording medium according to an embodiment will be individually described.

Substrate

The substrate may be a substrate constituted only by a base paper sheet, a substrate constituted only by a plastic film, or a substrate constituted only by a cloth. The substrate may be a substrate including plural layers. A specific example is a substrate including a base paper sheet and a resin layer, that is, a resin-coated substrate. In an embodiment, a resin-coated substrate, a plastic film, or a cloth can be used as the substrate. The resin-coated substrate may include a resin layer only on a single surface of the base paper sheet or may include a resin layer on each of both surfaces of the base paper sheet.

In an embodiment, the substrate preferably has a thickness of 50 μm or more and 400 μm or less, more preferably 70 μm or more and 200 μm or less. Herein, the thickness of the substrate is determined in the following manner: a section of the recording medium is cut out with a microtome; the section is observed with a scanning electron microscope and the thicknesses of the substrate at 100 or more given points are measured; and the average of the thicknesses is determined as the thickness of the substrate. Herein, the same manner also applies to determination of the thicknesses of the other layers.

(1) Resin-Coated Substrate

Base Paper Sheet

The base paper sheet is produced from wood pulp as the main raw material and optionally a synthetic pulp such as polypropylene pulp or synthetic fibers such as nylon fibers or polyester fibers. Examples of the wood pulp include hardwood bleached kraft pulp (LBKP), hardwood bleached sulfite pulp (LBSP), softwood bleached kraft pulp (NBKP), softwood bleached sulfite pulp (NBSP), hardwood dissolving pulp (LDP), softwood dissolving pulp (NDP), hardwood unbleached kraft pulp (LUKP), and softwood unbleached kraft pulp (NUKP). Of these wood pulps, one wood pulp may be used or two or more wood pulps may be optionally used. Of the wood pulps, LBKP, NBSP, LBSP, NDP, and LDP, which have high contents of short fibers, can be used. The pulps can be low-impurity chemical pulps (sulfate pulps and sulfite pulps). The pulps can be bleached pulps having enhanced whiteness. The paper substrates may be produced so as to appropriately contain additives such as sizing agents, white pigments, paper strength additives, fluorescent whitening agents, moisture retention agents, dispersing agents, and softening agents.

In an embodiment, the base paper sheet preferably has a thickness of 50 μm or more and 130 μm or less, more preferably 90 μm or more and 120 μm or less. Herein, the thickness of the base paper sheet is determined in the following manner: a section of the recording medium is cut out with a microtome; the section is observed with a scanning electron microscope and thicknesses of the base paper sheet at given 100 or more points are measured; and the average of the thicknesses is determined as the thickness of the base paper sheet. Herein, the same manner also applies to determination of the thicknesses of the other layers.

In an embodiment, the paper density (defined by JIS P 8118) of the base paper sheet is preferably 0.6 g/cm$^3$ or more and 1.2 g/cm$^3$ or less, more preferably 0.7 g/cm$^3$ or more and 1.2 g/cm$^3$ or less.

Resin Layer

In an embodiment in which the base paper sheet is covered with a resin, the resin layer is formed so as to cover at least a portion of the surface of the base paper sheet. The coverage of the resin layer (area of resin-layer-covered surface of base paper sheet/area of whole surface of base paper sheet) is preferably 70% or more, more preferably 90% or more, particularly preferably 100% in which case the whole surface of the base paper sheet is covered with the resin layer.

In an embodiment, the resin layer preferably has a thickness of 20 μm or more and 60 μm or less, more preferably 35 μm or more and 50 μm or less. When the resin layer is formed on each of both surfaces of the base paper sheet, the thickness of the resin layer on each surface can satisfy such a range.

The resin used for forming the resin layer can be a thermoplastic resin. Examples of the thermoplastic resin include acrylic resins, acrylic-silicone resins, polyolefin resins, and styrene-butadiene copolymers. Of these, polyolefin resins can be used. Herein, the term "polyolefin resins" means polymers synthesized from olefin monomers. Specific examples of the polyolefin resins include homopolymers and copolymers synthesized from monomers such as ethylene, propylene, and isobutylene. One polyolefin resin may be used or optionally two or more polyolefin resins may be used. In particular, polyethylene can be used. Examples of the polyethylene include low-density polyethylenes (LDPE) and high-density polyethylenes (HDPE).

In an embodiment, the resin layer may be formed so as to contain a white pigment, a fluorescent whitening agent, or ultramarine, for example, in order to adjust the opaqueness, whiteness, or hue of the layer. In particular, the resin layer can contain a white pigment to have enhanced opaqueness. The white pigment is, for example, rutile or anatase titanium oxide. In an embodiment, the resin layer can have a white-pigment content of 3 g/m$^2$ or more and 30 g/m$^2$ or less. When the resin layer is formed on each of both surfaces of the base paper sheet, the total white-pigment content of these two resin layers can satisfy the above-described range. The ratio of the white-pigment content to the resin content in the resin layer can be 25% by mass or less. When the ratio is more than 25% by mass, the dispersion stability of the white pigment may be insufficient.

In an embodiment, the resin layer preferably has an arithmetic average roughness Ra (defined by JIS B 0601: 2001) of 0.12 μm or more and 0.18 μm or less, more preferably 0.13 μm or more and 0.15 μm or less.

In an embodiment, the resin layer preferably has a mean width RSm of roughness profile elements (defined by JIS B 0601: 2001) of 0.01 mm or more and 0.20 mm or less, more preferably 0.04 mm or more and 0.15 mm or less.

(2) Plastic Film

Herein, the term "plastic" means a plastic that contains 50% or more by mass of a polymer having a molecular weight of 10,000 or more. The term "plastic film" means a film-shaped member composed of the plastic. The plastic used for forming the plastic film is a thermoplastic plastic and specific examples thereof include vinyl-based plastics, polyester-based plastics, cellulose ester-based plastics, polyamide-based plastics, and heat-resistant engineering plastics.

Examples of the vinyl-based plastics include polyethylene, polyvinyl chloride, polyvinylidene chloride, polyvinyl alcohol, polystyrene, polypropylene, and fluorine-based resins. Examples of the polyester-based resins include polycarbonate and polyethylene terephthalate. Examples of the cellulose ester-based plastics include cellulose diacetate, cellulose triacetate, and cellulose acetate butyrate. Examples of the polyamide-based plastics include nylon 6, nylon 66, and nylon 12. Examples of the heat-resistant engineering plastics include polyimide, polysulfone, polyether sulfone, polyphenylene sulfide, polyether ether ketone, and polyether imide. These plastics may be used alone or in combination of two or more thereof.

In an embodiment, from the standpoint of durability and cost, polyvinyl chloride, polypropylene, polycarbonate, or polyethylene terephthalate can be used.

In an embodiment, a synthetic paper sheet formed of the above-described plastic and formed by a treatment such as a chemical treatment, a surface coating treatment, or an internal addition treatment so as to have enhanced opaqueness may also be used as the plastic film. The chemical treatment is, for example, a treatment of immersing the plastic film in an organic solvent such as acetone or methyl isobutyl ketone to generate a swelling layer in the surface of the film and using another organic solvent such as methanol to dry and solidify the swelling layer. The surface coating treatment is, for example, a treatment of forming a layer on the surface of the plastic film, the layer being composed of a white pigment such as calcium carbonate or titanium oxide and a binder. The internal addition treatment is, for example, a treatment of adding, into the plastic, a filler that is a pigment such as calcium carbonate, titanium oxide, zinc oxide, white carbon, clay, talc, or barium sulfate. In an embodiment, a foamed plastic film may be used that is formed by adding a polybutylene terephthalate fine particle, a polycarbonate fine particle, a polyester resin, or a polycarbonate resin, for example, to form pores in the plastic to provide enhanced opaqueness.

In an embodiment, the plastic film preferably has a thickness of 50 μm or more and 300 μm or less, more preferably 75 μm or more and 135 μm or less.

In an embodiment, the plastic used for forming the plastic film preferably has a glass transition temperature of −20° C. or more and 150° C. or less, more preferably −20° C. or more and 80° C. or less. Herein, the glass transition temperature can be measured by, for example, differential scanning calorimetry (DSC).

In an embodiment, the plastic density (defined by JIS K 7112: 1999) of the plastic film is preferably 0.6 g/cm$^3$ or more and 1.5 g/cm$^3$ or less, more preferably 0.7 g/cm$^3$ or more and 1.4 g/cm$^3$ or less.

In an embodiment, the water absorption (defined by JIS K 7209: 2000) of the plastic film is preferably 5% by mass or less, more preferably 1% by mass or less.

In the case of using a plastic film, the plastic film may be surface-treated by a surface oxidation treatment to enhance the adhesion between the ink-receiving layer and the plastic film.

The surface oxidation treatment may be a corona discharge treatment, a flame treatment, a plasma treatment, a glow discharge treatment, or an ozone treatment. These treatments may be employed alone or in combination. In particular, the ozone treatment can be preformed and the treatment rate is preferably 10 to 200 W·min/m$^2$, more preferably 50 to 150 W·min/m$^2$.

(3) Cloth

Herein, the term "cloth" means a thin and wide plate-shaped member composed of a large number of fibers. Examples of the fibers include natural fibers, regenerated fibers produced from materials having natural-fiber properties or from plastics, and synthetic fibers formed from polymers such as petroleum polymers. Examples of the natural fibers include cotton, silk, hemp, mohair, wool, and cashmere. Examples of the regenerated fibers include acetate, cupra, rayon, and regenerated polyesters. Examples of the synthetic fibers include nylon, polyester, acrylic, vinylon, polyethylene, polypropylene, polyamide, and polyurethane.

Ink-Receiving Layer

In an embodiment, the ink-receiving layer may be a monolayer or a multilayer including two or more layers. The ink-receiving layer may be formed only on a single surface of the substrate or on each of both surfaces of the substrate.

In the embodiment according to the present disclosure, for the recording medium, the ratio of the total pore volume in the pore radius range of 7 nm or more and 20 nm or less to the total pore volume in the pore radius range of 0 nm or more and 20 nm or less needs to be 25% by volume or less.

The ink-receiving layer on a single surface of the substrate preferably has a thickness of 15 μm or more and 60 μm or less, more preferably 25 μm or more and 50 μm or less, particularly preferably 30 μm or more and 45 μm or less. The ink-receiving-layer coating liquid can be applied in an amount of 5 g/m$^2$ or more and 40 g/m$^2$ or less. When the ink-receiving-layer coating liquid is applied so as to satisfy the above-described range of amount, enhancement of the ink absorbency and enhancement of the coating stability of the coating liquid can be achieved.

Hereinafter, materials that can be contained in the ink-receiving layer will be individually described.

Inorganic Particle

In an embodiment, the ink-receiving layer contains an inorganic particle.

In an embodiment, an oil absorption of the inorganic particle is preferably 150 ml/100 g or more and 240 ml/100 g or less. When the oil absorption of the inorganic particle satisfies the above-described range of amount, enhancement of the ink absorbency, scratch resistance, and water resistance can be achieved. Especially, studies by the inventors of the present disclosure have revealed that the amount of a hydrophobic binder absorbed by an inorganic particle largely depends on the oil absorption of the inorganic particle and that the oil absorption of an inorganic particle correlates to the oil absorption of the ink-receiving layer. Specifically, the oil absorption is adjusted to be 240 ml/100 g or less, so that the hydrophobic binder becomes less absorbed by the inorganic particle and the hydrophobic binder sufficiently functions as a binder. Herein, the oil absorption is measured in accordance with the "refined linseed oil method" defined by JIS K 5101-13-1.

A BET specific surface area of the inorganic particle is preferably 380 m$^2$/g or more. The BET specific surface area is adjusted to be 380 m$^2$/g or more, so that the contact area between the hydrophobic binder and the inorganic particle is increased to further enhance the interaction therebetween, resulting in high scratch resistance. Herein, the BET specific surface area is a specific surface area determined by the BET method: molecules or ions having a known size are adsorbed on the sample surface and, on the basis of the adsorption amount, the specific surface area of the sample is determined. Herein, a gas adsorbed on the sample is nitrogen gas. In an embodiment, the oil absorption and the BET specific surface area of the inorganic particle in the ink-receiving layer can be measured from the recording medium. Specifically, a portion of the ink-receiving layer is scraped off and heated at 600° C. for 2 hours. The resultant residue obtained by heating the portion of the ink-receiving layer can be considered as the inorganic particle contained in the ink-receiving layer.

In an embodiment, in order to provide a recording medium such that the ratio of the total pore volume in the pore radius range of 7 nm or more and 20 nm or less to the total pore volume in the pore radius range of 0 nm or more and 20 nm or less is 25% by volume or less, the ratio of the total pore volume in the pore radius range of 7 nm or more and 20 nm or less to the total pore volume in the pore radius range of 0 nm or more and 20 nm or less in the inorganic particle can be 25% by volume or less.

In an embodiment, for the recording medium, the total pore volume in the pore radius range of 2 nm or more and 10 nm or less can be 0.2 ml/g or more. In order to satisfy this feature, for the inorganic particle, the total pore volume in the pore radius range of 2 nm or more and 10 nm or less can be 0.4 ml/g or more.

In an embodiment, a coating liquid in which the inorganic particle is dispersed with a dispersing agent may be used as the ink-receiving-layer coating liquid. The average secondary particle size of the inorganic particle being dispersed is preferably 1 μm or more and 20 μm or less, more preferably 3 μm or more and 9 μm or less. The average secondary particle size of the inorganic particle being dispersed is a volume-average secondary particle size measured by laser diffractometry.

In an embodiment, the inorganic particle content (% by mass) in the ink-receiving layer is preferably 40% by mass or more and 90% by mass or less, more preferably 50% by mass or more and 80% by mass or less.

Examples of the inorganic particle in an embodiment include inorganic particles formed of alumina hydrate, alumina, silica, colloidal silica, titanium dioxide, zeolite, kaoline, talc, hydrotalcite, zinc oxide, zinc hydroxide, aluminum silicate, calcium silicate, magnesium silicate, calcium carbonate, zirconium oxide, and zirconium hydroxide. Of these, one inorganic particle alone or optionally two or more inorganic particles can be used. Of the above-described inorganic particles, the silica particle, which enables formation of a porous structure having high ink absorbency, can be used.

Silica used for forming the ink-receiving layer is broadly divided into a silica produced by a wet process and a silica produced by a dry process (gas-phase process). As the wet process, there is a known process of causing acid decomposition of silicate to generate active silica and appropriately polymerizing the active silica to cause aggregation-precipitation to thereby obtain hydrated silica. On the other hand, as the dry process (gas-phase process), there are a known process of subjecting halogenated silicon to high-temperature gas-phase hydrolysis (flame hydrolysis) to obtain anhydrous silica and a known process (arc process) of subjecting silica sand and coke to reduction-vaporization by heating with arc discharge in an electric furnace and subjecting the vapor to oxidation in the air to obtain anhydrous silica. In an embodiment, a silica obtained by a wet process (hereafter, sometimes referred to as "wet-process silica") can be used. Examples of the wet-process silica include precipitated silica and silica gel.

Example of preparing silica particles using gel-process is described below:

First, preparing a silica hydrosol by reacting silicate, which concentration is 10% by mass to 20% by mass, with inorganic acid, and then gelling the silica hydrosol to form a silica hydrogel. Examples of the silicate used are Sodium silicate, Potassium silicate, Ammonium silicate and etc. Sodium silicate is broadly used in industrial manufacturing. Examples of inorganic acid are sulfuric acid, nitric acid, hydrochloric acid, and sulfuric acid is commonly used.

Next, washing the silica hydrogel with water to remove inorganic acid contained in silica hydrogel.

By washing the silica hydrogel with water, pore radius and oil absorption of the inorganic particles can be adjusted. Using the water that has pH 2 to 10, and a temperature of 20° C. to 100° C., resulting in larger pore radius and higher oil absorption value. By optimizing water pH, temperature and washing time, pore radius and oil absorption of inorganic acid can be controlled. For good balance between pore radius and oil absorption, washing the silica hydrogel with water pH between 2 and 8, a temperature of 40° C. to 90° C. is preferable.

Next step is, finely grinding the washed, hydrothermally treated silica hydrogel into particles having an average particle size or, then rapidly drying the silica hydrogel at a temperature of 100 to 1000° C. for 1 to 100 seconds to form a dried silica particles.

Binder

In an embodiment, the ink-receiving layer contains a binder. Herein, the term "binder" means a material that binds the inorganic particle and forms a film. In an embodiment, the binder contains at least one selected from acrylic resins and urethane resins.

In an embodiment, the ink-receiving layer (1) does not contain any water-soluble resin or (2) contains the water-soluble resin such that the ratio of the content of the water-soluble resin to the content of the binder in the ink-receiving layer is 20% by mass or less. In other words, the ratio of the content of the water-soluble resin to the content of the binder in the ink-receiving layer needs to be 0% by mass or more and 20% by mass or less, preferably 0% by mass or more and 15% by mass or less, more preferably 0% by mass or more and 10% by mass or less. As to whether this feature is satisfied in a produced recording medium can be judged by a method described below. Examples of the water-soluble resin include polyvinyl alcohol and polyvinyl alcohol derivatives.

From the recording medium, 10 g of the ink-receiving layer is scraped off, placed into 1,000 g or more of hot water (water temperature of 80° C.), and subjected to stirring. The resultant liquid is filtered; the solid content is dried and the mass thereof is measured (defined as X g). At this time, the value calculated by the formula "10 (g)−X (g)" is the content of the water-soluble resin in 10 g (scraped portion) of the ink-receiving layer.

Similarly, from the recording medium, 10 g of the ink-receiving layer is scraped off and heated at a temperature of 600° C. for 2 hours. The mass of the residue is measured (defined as Y g). At this time, the value calculated by the formula "10 (g)−Y (g)" is the content of the binder in 10 g (scraped portion) of the ink-receiving layer.

Thus, the formula "(10 (g)−X (g))/(10 (g)−Y (g))" gives the content ratio of the water-soluble resin to the binder. When this value is 0% by mass or more and 20% by mass or less, the recording medium is judged to satisfy the above-described feature regarding the water-soluble resin.

In an embodiment, an acrylic resin and a urethane resin can be used in the form of resin particles in the ink-receiving-layer coating liquid (emulsion).

In an embodiment, from the standpoint of ink absorbency, the ratio of the content of the binder to the content of the inorganic particle in the ink-receiving layer is preferably 100% by mass or less, more preferably 70% by mass or less. From the standpoint of the bindability of the ink-receiving layer, the ratio is preferably 30% by mass or more, more preferably 50% by mass or more.

In an embodiment, a glass transition temperature of at least one resin selected from a group consisting of the acrylic resins, polycarbonate-modified urethane resins, and polyether-modified urethane resins is preferably 20° C. or less. The glass transition temperature (Tg) of the resin can be measured by, for example, differential scanning calorimetry (DSC).

In an embodiment, from the standpoint of the color developability of images to be formed, at least one resin selected from a group consisting of the acrylic resins, polycarbonate-modified urethane resins, and polyether-modified urethane resins is preferably a cationic resin. From the standpoint of the coating stability of the ink-receiving-layer coating liquid, at least one resin selected from a group consisting of the acrylic resins, polycarbonate-modified urethane resins, and polyether-modified urethane resins is preferably a nonionic resin.

(1) Acrylic Resin

Herein, the term "acrylic resin" means a polymer of a (meth)acrylate. The acrylic resin, which is synthesized at least from a (meth)acrylate monomer, may be a homopolymer or a copolymer of the (meth)acrylate monomer and another monomer.

Examples of the acrylate include methyl acrylate, ethyl acrylate, butyl acrylate, 2-ethylhexyl acrylate, 2-dimethylaminoethyl acrylate, 2-hydroxyethyl acrylate, 2-hydroxypropyl acrylate, 2-hydroxybutyl acrylate, isobutyl acrylate, octyl acrylate, lauryl acrylate, and stearyl acrylate. Examples of the methacrylate include methyl methacrylate, ethyl methacrylate, butyl methacrylate, 2-ethylhexyl methacrylate, 2-dimethylaminoethyl methacrylate, 2-hydroxyethyl methacrylate, 2-hydroxypropyl methacrylate, 2-hydroxybutyl methacrylate, isobutyl methacrylate, octyl methacrylate, lauryl methacrylate, and stearyl methacrylate. Such monomers may be copolymerized with other monomers. Examples of the other monomers that may be copolymerized with (meth)acrylates include vinyl-based monomers. Specific examples of the vinyl-based monomers include styrenes and derivatives thereof such as styrene, vinyltoluene, vinylbenzoic acid, α-methylstyrene, p-hydroxymethylstyrene, and styrenesulfonic acid; and vinyl ethers and derivatives thereof such as methyl vinyl ether, butyl vinyl ether, methoxyethyl vinyl ether, N-vinylpyrrolidone, 2-vinyloxazolone, and vinylsulfonic acid.

In an embodiment, the acrylic resin can be a polyacrylate, a polymethacrylate, or a copolymer of an acrylate and a methacrylate. In particular, a copolymer of a methacrylate having a relatively high glass transition temperature and an acrylate having a relatively low glass transition temperature can be employed because the glass transition temperature of the resultant acrylic resin can be controlled by changing the copolymerization ratio of the monomers.

(2) Urethane Resin (Polycarbonate-Modified Urethane Resin and Polyether-Modified Urethane Resin)

Herein, the term "urethane resin" means a resin having urethane bonds. In an embodiment, when the binder contains a urethane resin, the urethane resin needs to be at least one selected from polycarbonate-modified urethane resins and polyether-modified urethane resins. Hereafter, polycarbonate-modified urethane resins and polyether-modified urethane resins are sometimes collectively referred to as a "urethane resin".

Specifically, the urethane resin can be a compound obtained by reacting a polyisocyanate, a polyol, and a chain extender. Specific examples of the polyisocyanate include aromatic isocyanates such as tolylene diisocyanate, diphenylmethane diisocyanate, polymeric diphenylmethane diisocyanate, tolidine diisocyanate, naphthalene diisocyanate, xylylene diisocyanate, and tetramethylxylylene diisocyanate; and aliphatic isocyanates and alicyclic isocyanates such as hexamethylene diisocyanate, trimethylhexamethylene diisocyanate, and isophorone diisocyanate. Examples of the polyol include polyether-based polyols such as polypropylene glycol, polyethylene glycol, and polytetramethylene glycol; and polycarbonate-based polyols such as polyhexamethylene carbonate. Examples of the chain extender include compounds having active hydrogen atoms, for example, low-molecular-weight glycols such as ethylene glycol, low-molecular-weight diamines, and low-molecular-weight amino alcohols. Such compounds may be used alone or in combination of two or more appropriately selected therefrom.

(3) Other Binder

In an embodiment, the ink-receiving layer may contain another material as a binder. In particular, in an embodiment, the ink-receiving layer may further contain an ethylene-vinyl acetate copolymer from the standpoint of further enhancing the ink absorbency. In the ethylene-vinyl acetate copolymer, the ratio of the unit derived from ethylene (moiety formed by polymerization of ethylene) is preferably 10% by mass or more and 30% by mass or less, more preferably 10% by mass or more and 20% by mass or less. When this ratio is more than 30% by mass, the copolymer may have bindability insufficient as binder. When this ratio is less than 10% by mass, that is, the content of the unit derived from highly hydrophilic vinyl acetate is high, the effect of enhancing the water resistance may be insufficiently provided.

The ratio of the content of the ethylene-vinyl acetate copolymer to the total binder content in the ink-receiving layer is preferably 5% by mass or more and 50% by mass or less, more preferably 10% by mass or more and 30% by mass or less.

Other Additives

In an embodiment, the ink-receiving layer containing the above-described components may further contain other additives. Specific examples of the additives include cross-linking agents, pH adjusters, thickeners, fluidizing agents, antifoaming agents, foam inhibitors, surfactants, release agents, penetrants, color pigments, color dyes, fluorescent whitening agents, ultraviolet absorbing agents, antioxidants, preservatives, fungicides, water resistant additives, ink fixing agents, curing agents, and weather resistant materials.

Examples of the cross-linking agents include aldehyde-based compounds, melamine-based compounds, isocyanate-based compounds, zirconium-based compounds, titanium-based compounds, amide-based compounds, aluminum-based compounds, boric acid, borates, carbodiimide-based compounds, and oxazoline-based compounds.

Examples of the ink fixing agents include cationic resins other than the above-described acrylic resins and urethane resins, and polyvalent metal salts.

Examples of the cationic resins include polyethylene imine-based resins, polyamine-based resins, polyamide-based resins, polyamide epichlorohydrin-based resins, polyamine epichlorohydrin-based resins, polyamide polyamine epichlorohydrin-based resins, polydiallylamine-based resins, and dicyandiamide condensates. Examples of the polyvalent metal salts include calcium compounds, magnesium compounds, zirconium compounds, titanium compounds, and aluminum compounds. Of these, preferred are calcium compounds and more preferred is calcium nitrate tetrahydrate.

Method for Producing Recording Medium

A non-limiting method for producing a recording medium according to an embodiment includes a step of preparing an ink-receiving-layer coating liquid and a step of applying the ink-receiving-layer coating liquid to a substrate. Hereinafter, the method for producing a recording medium will be described.

For producing a recording medium according to an embodiment, a method for forming an ink-receiving layer on a substrate is, for example, as follows: an ink-receiving-layer coating liquid is prepared; and the coating liquid is applied to a substrate and dried to provide a recording medium according to the embodiment. The process of applying the coating liquid may be performed with, for example, a roll coater, a blade coater, a bar coater, an air knife coater, a gravure coater, a reverse coater, a transfer coater, a die coater, a kiss coater, a rod coater, a curtain coater, an extrusion coater, or a slide-hopper coater. During coating, the coating liquid may be heated.

Before the ink-receiving-layer coating liquid is applied, a surface (to be coated with the coating liquid) of the substrate may be coated with a surface treatment solution containing a surface treating agent. As a result, the wettability of the coating liquid over the substrate is enhanced to thereby enhance the adhesion between the ink-receiving layer and the substrate. In this case, examples of the surface treating agent include thermoplastic resins such as acrylic resins, polyurethane resins, polyester resins, polyethylene resins, polyvinyl chloride resins, polypropylene resins, polyamide resins, and styrene-butadiene copolymers, and silane coupling agents. These agents may be used alone or in combination of two or more appropriately selected therefrom. The surface treatment solution may contain an inorganic particle as long as advantages according to the embodiment are provided. Examples of the inorganic particle include those listed above. Examples of the process of drying the applied liquid include a process of using a hot-air dryer such as a straight tunnel dryer, an arch dryer, an air loop dryer, or a sine-wave-configuration air-floatation dryer, and a process of using an infrared dryer, a heating dryer, or a microwave dryer.

EXAMPLES

Hereinafter, the present disclosure will be described further in detail with reference to Examples and Comparative examples. However, the following Examples do not limit at all the present disclosure; the present disclosure may be embodied in forms other than the following Examples without departing from the spirit and scope of the present disclosure. Note that the term "parts" in EXAMPLES below means parts by mass unless otherwise specified.

Production of Recording Medium

Preparation of Substrate

As a substrate 1, a NEWYUPO FGS110 (manufactured by YUPO CORPORATION), which is a polypropylene synthetic paper sheet, was prepared. A substrate 2 was prepared by subjecting a surface of a polypropylene film to a corona treatment (100 W·min/$m^2$), coating the corona-treated surface of the film with a surface treatment solution containing an acrylic resin such that the dry solid content became 3 g/$m^2$, and drying the solution.

Preparation of Inorganic-Particle Dispersion Liquid

An inorganic particle described in Table 1 was added to pure water. The resultant liquid was stirred with a mixer for 30 minutes to prepare an inorganic-particle dispersion liquid having a solid content of 15.0% by mass.

The oil absorption (ml/100 g) of the inorganic particle was measured by the refined linseed oil method. In addition, the BET specific surface area ($m^2$/g) and pore distribution of the inorganic particle were measured by a nitrogen adsorption method with a Micromeritics Automatic Surface Area and Porosimetry Analyzer TriStar 3000 (manufactured by SHIMADZU CORPORATION). On the basis of the measurement result, the following were calculated: the total pore volume (ml/g) in the pore radius range of 2 nm or more and 10 nm or less; and the ratio (% by volume) of the total pore volume in the pore radius range of 7 nm or more and 20 nm or less to the total pore volume in the pore radius range of 0 nm or more and 20 nm or less. The results are also described in Table 1. Note that the product names of inorganic particles (all are wet-process silica particles) in Table 1 and their manufactures are listed below.

MIZUKASIL P-50 (manufactured by Mizusawa Industrial Chemicals, Ltd.)

MIZUKASIL P-73 (manufactured by Mizusawa Industrial Chemicals, Ltd.)

MIZUKASIL P-707 (manufactured by Mizusawa Industrial Chemicals, Ltd.)

SYLOID 72 (manufactured by Grace)

SYLOID C503 (manufactured by Grace)

SYLYSIA 430 (manufactured by FUJI SILYSIA CHEMICAL LTD.)

SYLYSIA 440 (manufactured by FUJI SILYSIA CHEMICAL LTD.)

SILYSIA 440 (manufactured by SILYSIAMONT S.p.A)

NIPGEL CY-200 (manufactured by TOSOH SILICA CORPORATION)

NIPGEL E-75 (manufactured by TOSOH SILICA CORPORATION)

NIPGEL AY-603 (manufactured by TOSOH SILICA CORPORATION)

NIPGEL BZ-400 (manufactured by TOSOH SILICA CORPORATION)

As the synthesized silica 1, prepared by silica-gel process, by treating the silica hydrogel with adjusted water pH, temperature and washing time to obtain the silica particle that has properties as described in Table 1.

TABLE 1

Type and physical properties of inorganic-particle dispersion liquids

| Inorganic-particle dispersion liquid No. | Type of inorganic particle Product name | Physical properties: Average secondary particle size (μm) | Oil absorption (ml/100 g) | BET specific surface area ($m^2$/g) |
|---|---|---|---|---|
| Inorganic-particle dispersion liquid 1 | MIZUKASIL P-50 | 7.0 | 170 | 420 |
| Inorganic-particle dispersion liquid 2 | MIZUKASIL P-73 | 4.0 | 180 | 450 |
| Inorganic-particle dispersion liquid 3 | SYLOID 72 | 5.1 | 200 | 390 |
| Inorganic-particle dispersion liquid 4 | SILYSIA 440 (manufactured by SILYSIAMONT S.p.A) | 6.2 | 220 | 600 |
| Inorganic-particle dispersion liquid 5 | NIPGEL CY-200 | 5.5 | 185 | 754 |
| Inorganic-particle dispersion liquid 6 | MIZUKASIL P-707 | 4.0 | 250 | 300 |
| Inorganic-particle dispersion liquid 7 | SYLOID C503 | 3.7 | 315 | 300 |
| Inorganic-particle dispersion liquid 8 | NIPGEL E-75 | 4.6 | 120 | 45 |
| Inorganic-particle dispersion liquid 9 | NIPGEL AY-603 | 10.3 | 260 | 300 |

TABLE 1-continued

| Type and physical properties of inorganic-particle dispersion liquids | | | | |
|---|---|---|---|---|
| | | Physical properties | | |
| Inorganic-particle dispersion liquid No. | Type of inorganic particle Product name | Average secondary particle size (μm) | Oil absorption (ml/100 g) | BET specific surface area ($m^2/g$) |
| Inorganic-particle dispersion liquid 10 | NIPGEL BZ-400 | 6.2 | 285 | 473 |
| Inorganic-particle dispersion liquid 11 | SYLYSIA 430 | 4.1 | 230 | 350 |
| Inorganic-particle dispersion liquid 12 | SILYSIA 440 (manufactured by FUJI SILYSIA CHEMICAL LTD.) | 6.2 | 220 | 350 |
| Inorganic-particle dispersion liquid 13 | Synthesized Silica 1 | 5.0 | 310 | 416 |

Production of Recording Media

Recording media were produced by procedures described below. In each of the resultant recording media, the BET specific surface area ($m^2/g$) and pore distribution of the recording medium were measured by a nitrogen adsorption method with a Micromeritics Automatic Surface Area and Porosimetry Analyzer TriStar 3000 (manufactured by SHIMADZU CORPORATION). On the basis of the measurement result, the following were calculated: the total pore volume (ml/g) in the pore radius range of 2 nm or more and 10 nm or less; and the ratio (% by volume) of the total pore volume in the pore radius range of 7 nm or more and 20 nm or less to the total pore volume in the pore radius range of 0 nm or more and 20 nm or less. The results are described in Table 2.

Production of Recording Medium 1

An ink-receiving-layer coating liquid having a solid content of 20% by mass was prepared by adding 16.93 parts of a cationic acrylic resin Mowinyl 7820 (manufactured by The Nippon Synthetic Chemical Industry Co., Ltd.; solid content: 45% by mass, Tg: 4° C.), 0.95 parts of calcium nitrate tetrahydrate, 76.19 parts of the inorganic-particle dispersion liquid 1, and 5.93 parts of water. This coating liquid was applied to the substrate 1 such that the dry coating amount ($g/m^2$) became 25 $g/m^2$. The coating liquid was dried with hot air at 115° C. to provide a recording medium 1.

Production of Recording Media 2 to 5

Recording media 2 to 5 were produced as in "Production of Recording Medium 1" above except that the inorganic-particle dispersion liquid 1 used for the ink-receiving-layer coating liquid was changed to the inorganic-particle dispersion liquids 2 to 5.

Production of Recording Medium 6

A recording medium 6 was produced as in "Production of Recording Medium 1" above except that the cationic acrylic resin used for the ink-receiving-layer coating liquid was changed to 16.93 parts of a nonionic acrylic resin Mowinyl 7720 (manufactured by The Nippon Synthetic Chemical Industry Co., Ltd.; solid content: 45% by mass, Tg: 4° C.).

Production of Recording Medium 7

A recording medium 7 was produced as in "Production of Recording Medium 1" above except that 16.93 parts of the cationic acrylic resin and 5.93 parts of water for the ink-receiving-layer coating liquid were changed to 21.77 parts of a polycarbonate-modified urethane resin HYDRAN WLS210 (manufactured by DIC Corporation; solid content: 35% by mass, Tg: −15° C.) and 1.09 parts of water.

Production of Recording Medium 8

A recording medium 8 was produced as in "Production of Recording Medium 1" above except that 16.93 parts of the cationic acrylic resin and 5.93 parts of water used for the ink-receiving-layer coating liquid were changed to 16.93 parts of an acrylic resin Bonron T-733 (manufactured by The Mitsui Chemical Industry Co., Ltd.; solid content: 49% by mass, Tg: 23° C.).

Production of Recording Medium 9

A recording medium 9 was produced as in "Production of Recording Medium 1" above except that 16.93 parts of the cationic acrylic resin and 5.93 parts of water used for the ink-receiving-layer coating liquid were changed to 21.77 parts of a polyether-modified urethane resin HYDRAN WLS201 (manufactured by DIC Corporation; solid content: 35% by mass, Tg: −50° C.) and 1.09 parts of water.

Production of Recording Medium 10

A recording medium 10 was produced as in "Production of Recording Medium 1" above except that 16.93 parts of the cationic acrylic resin and 5.93 parts of water used for the ink-receiving-layer coating liquid were changed to 13.33 parts of the cationic acrylic resin, 3.64 parts of an ethylene-vinyl acetate copolymer Sumikaflex 355HQ (manufactured by Sumika Chemtex Company, Limited; solid content: 55% by mass), and 3.03 parts of water.

Production of Recording Medium 11

A recording medium 11 was produced as in "Production of Recording Medium 10" above except that the inorganic-particle dispersion liquid 1 used for the ink-receiving-layer coating liquid was changed to the inorganic-particle dispersion liquid 4.

Production of Recording Medium 12

A recording medium 12 was produced as in "Production of Recording Medium 11" above except that the ethylene-vinyl acetate copolymer Sumikaflex 355HQ used for the ink-receiving-layer coating liquid was changed to an ethylene-vinyl acetate copolymer Mowinyl 109E (manufactured by The Nippon Synthetic Chemical Industry Co., Ltd.; solid content: 55% by mass).

Production of Recording Medium 13

A recording medium 13 was produced as in "Production of Recording Medium 12" above except that the inorganic-particle dispersion liquid 4 used for the ink-receiving-layer coating liquid was changed to the inorganic-particle dispersion liquid 3.

Production of Recording Medium 14

A recording medium 14 was produced as in "Production of Recording Medium 12" above except that 14.81 parts of the cationic acrylic resin, 1.73 parts of the ethylene-vinyl acetate copolymer Mowinyl 109E, and 6.31 parts of water were used.

Production of Recording Medium 15

A recording medium 15 was produced as in "Production of Recording Medium 12" above except that 8.47 parts of the cationic acrylic resin, 6.93 parts of the ethylene-vinyl acetate copolymer Mowinyl 109E, and 7.47 parts of water were used.

Production of Recording Medium 16

A recording medium 16 was produced as in "Production of Recording Medium 12" above except that 4.23 parts of the cationic acrylic resin, 10.39 parts of the ethylene-vinyl acetate copolymer Mowinyl 109E, and 8.23 parts of water were used.

Production of Recording Medium 17

A recording medium 17 was produced as in "Production of Recording Medium 4" above except that the substrate 1 was changed to the substrate 2.

Production of Recording Medium 18

A recording medium 18 was produced as in "Production of Recording Medium 12" above except that the substrate 1 was changed to the substrate 2.

Production of Recording Media 19 to 25

Recording media 19 to 25 were produced as in "Production of Recording Medium 1" above except that the inorganic-particle dispersion liquid 1 used for the ink-receiving-layer coating liquid was changed to the inorganic-particle dispersion liquids 6 to 11.

Production of Recording Medium 26

An ink-receiving-layer coating liquid having a solid content of 18% by mass was prepared by adding 11.43 parts of a cationic acrylic resin Mowinyl 7820 (manufactured by The Nippon Synthetic Chemical Industry Co., Ltd.; solid content: 45% by mass, Tg: 4° C.), 12.24 parts of a polyvinyl alcohol PVA124 (manufactured by KURARAY CO., LTD.; solid content: 14% by mass), 0.86 parts of calcium nitrate tetrahydrate, 68.57 parts of an inorganic-particle dispersion liquid, and 6.9 parts of water. This coating liquid was applied to the substrate 1 such that the dry coating amount (g/m$^2$) became 25 g/m$^2$. The coating liquid was dried with hot air at 115° C. to provide a recording medium 26. The ratio of the content of the water-soluble resin (polyvinyl alcohol) to the binder content in the ink-receiving layer of the recording medium 26 is 25% by mass.

Production of Recording Medium 27

An ink-receiving-layer coating liquid having a solid content of 15% by mass was prepared by adding 40.82 parts of a polyester-modified urethane resin NS310X (manufactured by TAKAMATSU OIL & FAT CO., LTD.; solid content: 14% by mass), 0.71 parts of calcium nitrate tetrahydrate, 57.14 parts of an inorganic-particle dispersion liquid, and 1.33 parts of water. This coating liquid was applied to the substrate 1 such that the dry coating amount (g/m$^2$) became 25 g/m$^2$. The coating liquid was dried with hot air at 115° C. to provide a recording medium 27.

Production of Recording Medium 28

A recording medium 28 was produced as in "Production of Recording Medium 26" above except that 11.43 parts of the cationic acrylic resin was changed to 12.19 parts of the cationic acrylic resin, 12.24 parts of the polyvinyl alcohol was changed to 9.80 parts of the polyvinyl alcohol, and 6.9 parts of water was changed to 8.59 parts of water.

The ratio of the content of the water-soluble resin (polyvinyl alcohol) to the binder content in the ink-receiving layer of the recording medium 28 is 20% by mass.

Production of Recording Medium 29

A recording medium 29 was produced as in "Production of Recording Medium 1" above except that the inorganic-particle dispersion liquid 1 used for the ink-receiving-layer coating liquid was changed to the inorganic-particle dispersion liquid 13.

TABLE 2

Production conditions and physical properties of recording media

| Recording medium No. | Substrate | Ink-receiving-layer coating liquid: Inorganic-particle dispersion liquid No. | Ink-receiving-layer coating liquid: Type of binder | Recording medium: Ratio of pore volume *1 (%) | Recording medium: Total pore volume *2 (ml/g) |
|---|---|---|---|---|---|
| Recording medium 1 | Substrate 1 | Inorganic-particle dispersion liquid 1 | Acrylic resin | 5.6 | 0.34 |
| Recording medium 2 | Substrate 1 | Inorganic-particle dispersion liquid 2 | Acrylic resin | 10.0 | 0.28 |
| Recording medium 3 | Substrate 1 | Inorganic-particle dispersion liquid 3 | Acrylic resin | 3.2 | 0.59 |
| Recording medium 4 | Substrate 1 | Inorganic-particle dispersion liquid 4 | Acrylic resin | 19.9 | 0.43 |
| Recording medium 5 | Substrate 1 | Inorganic-particle dispersion liquid 5 | Acrylic resin | 23.0 | 0.21 |
| Recording medium 6 | Substrate 1 | Inorganic-particle dispersion liquid 1 | Acrylic resin | 5.8 | 0.33 |
| Recording medium 7 | Substrate 1 | Inorganic-particle dispersion liquid 1 | Polycarbonate-modified urethane resin | 3.4 | 0.28 |
| Recording medium 8 | Substrate 1 | Inorganic-particle dispersion liquid 1 | Acrylic resin | 3.5 | 0.28 |
| Recording medium 9 | Substrate 1 | Inorganic-particle dispersion liquid 1 | Polyether-modified urethane resin | 3.4 | 0.29 |
| Recording medium 10 | Substrate 1 | Inorganic-particle dispersion liquid 1 | Acrylic resin/ethylene-vinyl acetate copolymer | 1.7 | 0.45 |
| Recording medium 11 | Substrate 1 | Inorganic-particle dispersion liquid 4 | Acrylic resin/ethylene-vinyl acetate copolymer | 21.4 | 0.44 |
| Recording medium 12 | Substrate 1 | Inorganic-particle dispersion liquid 4 | Acrylic resin/ethylene-vinyl acetate copolymer | 20.3 | 0.41 |
| Recording medium 13 | Substrate 1 | Inorganic-particle dispersion liquid 3 | Acrylic resin/ethylene-vinyl acetate copolymer | 5.2 | 0.67 |
| Recording medium 14 | Substrate 1 | Inorganic-particle dispersion liquid 4 | Acrylic resin/ethylene-vinyl acetate copolymer | 20.9 | 0.43 |
| Recording medium 15 | Substrate 1 | Inorganic-particle dispersion liquid 4 | Acrylic resin/ethylene-vinyl acetate copolymer | 20.1 | 0.39 |
| Recording medium 16 | Substrate 1 | Inorganic-particle dispersion liquid 4 | Acrylic resin/ethylene-vinyl acetate copolymer | 19.8 | 0.40 |
| Recording medium 17 | Substrate 2 | Inorganic-particle dispersion liquid 4 | Acrylic resin | 19.9 | 0.43 |
| Recording medium 18 | Substrate 2 | Inorganic-particle dispersion liquid 4 | Acrylic resin/ethylene-vinyl acetate copolymer | 20.9 | 0.43 |
| Recording medium 19 | Substrate 1 | Inorganic-particle dispersion liquid 6 | Acrylic resin | 68.2 | 0.61 |
| Recording medium 20 | Substrate 1 | Inorganic-particle dispersion liquid 7 | Acrylic resin | 74.4 | 0.39 |
| Recording medium 21 | Substrate 1 | Inorganic-particle dispersion liquid 8 | Acrylic resin | 79.6 | 0.01 |
| Recording medium 22 | Substrate 1 | Inorganic-particle dispersion liquid 9 | Acrylic resin | 86.8 | 0.48 |
| Recording medium 23 | Substrate 1 | Inorganic-particle dispersion liquid 10 | Acrylic resin | 36.3 | 0.37 |
| Recording medium 24 | Substrate 1 | Inorganic-particle dispersion liquid 11 | Acrylic resin | 57.3 | 0.65 |

TABLE 2-continued

Production conditions and physical properties of recording media

| Recording medium No. | Substrate | Ink-receiving-layer coating liquid: Inorganic-particle dispersion liquid No. | Ink-receiving-layer coating liquid: Type of binder | Recording medium: Ratio of pore volume *1 (%) | Recording medium: Total pore volume *2 (ml/g) |
|---|---|---|---|---|---|
| Recording medium 25 | Substrate 1 | Inorganic-particle dispersion liquid 12 | Acrylic resin | 57.3 | 0.65 |
| Recording medium 26 | Substrate 1 | Inorganic-particle dispersion liquid 1 | Acrylic resin/polyvinyl alcohol | 11.4 | 0.37 |
| Recording medium 27 | Substrate 1 | Inorganic-particle dispersion liquid 1 | Polyester-modified urethane resin | 5.2 | 0.32 |
| Recording medium 28 | Substrate 1 | Inorganic-particle dispersion liquid 1 | Acrylic resin/polyvinyl alcohol | 11.4 | 0.37 |
| Recording medium 29 | Substrate 1 | Inorganic-particle dispersion liquid 13 | Acrylic resin | 15.3 | 0.52 |

*1: The ratio of the total pore volume in the pore radius range of 7 nm or more and 20 nm or less to the total pore volume in the pore radius range of 0 nm or more and 20 nm or less
*2: The total pore volume in the pore radius range of 2 nm or more and 10 nm or less In Table 2, the unit "%" of Ratio of pore volume is "% by volume".

Evaluations

In the evaluation system of each of the following evaluation items, grades AA to B− are above the acceptable level and grade C is below the acceptable level.

Scratch Resistance

With an AB-301 COLOR FASTNESS RUBBING TESTER (manufactured by TESTER SANGYO CO., LTD.), a black paper sheet NewColor R (manufactured by LINTEC Corporation) was rubbed against, in a reciprocating manner for 20 cycles and under a load of 75 g/cm$^2$, a surface (having the ink-receiving layer) of each recording medium. A change ratio in the optical density of the surface (pressed to the recording medium) of the black paper sheet before and after the test was determined with an optical reflectance densitometer 500 spectrodensitometer (manufactured by X-Rite Inc.). The higher the change ratio in the optical density, the larger the amount of shavings that have been separated from the ink-receiving layer and adhere to the black paper sheet, that is, the lower the scratch resistance of the recording medium. The evaluation system is as follows. The evaluation results are described in Table 3.

A: The change ratio in the optical density is less than 20%.
B: The change ratio in the optical density is 20% or more and less than 35%.
B−: The change ratio in the optical density is 35% or more and less than 45%.
C: The change ratio in the optical density is 45% or more.

Water Resistance

Each recording medium was immersed in hot water at 80° C. for 5 hours and dried. The scratch resistance of the dried recording medium was measured in the same manner as above. The higher the change ratio in the optical density, the lower the scratch resistance after wetting, that is, the lower the water resistance of the recording medium. The evaluation system is as follows. The evaluation results are described in Table 3.

A: The change ratio in the optical density is less than 20%.
B: The change ratio in the optical density is 20% or more and less than 40%.
C: The change ratio in the optical density is 40% or more.

Ink Absorbency

An inkjet recording apparatus was used to record a solid image at a duty of 140% on each recording medium with cyan ink. The presence of unabsorbed ink on the recorded image was visually inspected and evaluated on the basis of the evaluation system described below. Specifically, the inkjet recording apparatus that was an imagePROGRAF iPF6400 (manufactured by CANON KABUSHIKI KAISHA) equipped with an ink tank PFI-106 (manufactured by CANON KABUSHIKI KAISHA) was used under recording conditions of a temperature of 23° C. and a relative humidity of 50%. Regarding the duty, an image recorded with the inkjet recording apparatus at a resolution of 1200 dpi×1200 dpi by applying about 4.5 ng of an ink droplet to a 1/1200 inch×1/1200 inch unit area is defined as an image recorded at a recording duty of 100%. The evaluation results are described in Table 3.

AA: The presence of unabsorbed ink is substantially not observed.
A: The presence of unabsorbed ink is slightly observed.
B: The presence of unabsorbed ink is observed.
C: The presence of unabsorbed ink is clearly observed.

TABLE 3

Evaluation results

| Example No. | Recording medium No. | Evaluation results: Scratch resistance | Evaluation results: Water resistance | Evaluation results: Ink absorbency |
|---|---|---|---|---|
| Example 1 | Recording medium 1 | A | A | A |
| Example 2 | Recording medium 2 | A | A | A |
| Example 3 | Recording medium 3 | A | A | A |
| Example 4 | Recording medium 4 | A | A | A |
| Example 5 | Recording medium 5 | A | A | B |
| Example 6 | Recording medium 6 | A | A | A |
| Example 7 | Recording medium 7 | A | A | A |
| Example 8 | Recording medium 8 | B- | B | A |
| Example 9 | Recording medium 9 | A | A | A |

TABLE 3-continued

| Evaluation results | | | | |
|---|---|---|---|---|
| | | Evaluation results | | |
| Example No. | Recording medium No. | Scratch resistance | Water resistance | Ink absorbency |
| Example 10 | Recording medium 10 | A | A | AA |
| Example 11 | Recording medium 11 | A | A | AA |
| Example 12 | Recording medium 12 | A | A | AA |
| Example 13 | Recording medium 13 | A | A | AA |
| Example 14 | Recording medium 14 | A | A | AA |
| Example 15 | Recording medium 15 | A | A | AA |
| Example 16 | Recording medium 16 | A | B | AA |
| Example 17 | Recording medium 17 | A | A | A |
| Example 18 | Recording medium 18 | A | A | AA |
| Example 19 | Recording medium 28 | A | B | AA |
| Example 20 | Recording medium 29 | B- | A | AA |
| Comparative example 1 | Recording medium 19 | C | C | AA |
| Comparative example 2 | Recording medium 20 | C | C | AA |
| Comparative example 3 | Recording medium 21 | A | A | C |
| Comparative example 4 | Recording medium 22 | C | C | AA |
| Comparative example 5 | Recording medium 23 | C | C | A |
| Comparative example 6 | Recording medium 24 | B | C | A |
| Comparative example 7 | Recording medium 25 | A | C | AA |
| Comparative example 8 | Recording medium 26 | A | C | A |
| Comparative example 9 | Recording medium 27 | A | C | A |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-052528, filed Mar. 16, 2015, and Japanese Patent Application No. 2015-052529, filed Mar. 16, 2015, which are hereby incorporated by reference herein in their entirety.

What is claimed is:

1. A recording medium comprising:

a substrate; and an ink-receiving layer, wherein the ink-receiving layer contains an inorganic particle and a binder, and does not contain any water-soluble resin or contains a water-soluble resin such that a ratio of a content of the water-soluble resin to a content of the binder in the ink-receiving layer is 20% by mass or less, the binder contains at least one component selected from the group consisting of acrylic resins, polycarbonate-modified urethane resins, and polyether-modified urethane resins, and for the recording medium, a ratio of a total pore volume in a pore radius range of 7 nm or more and 20 nm or less to a total pore volume in a pore radius range of 0 nm or more and 20 nm or less is 25% by volume or less.

2. The recording medium according to claim 1, wherein, for the inorganic particle, a ratio of a total pore volume in a pore radius range of 7 nm or more and 20 nm or less to a total pore volume in a pore radius range of 0 nm or more and 20 nm or less is 25% by volume or less.

3. The recording medium according to claim 1, wherein the binder containing at least one resin selected from a group consisting of the acrylic resins, polycarbonate-modified urethane resins, and polyether-modified urethane resins is a cationic resin.

4. The recording medium according to claim 1, wherein the binder containing at least one resin selected from a group consisting of the acrylic resins, polycarbonate-modified urethane resins, and polyether-modified urethane resins is a nonionic resin.

5. The recording medium according to claim 1, wherein the binder contains at least one resin selected from the group consisting of the acrylic resins, the polycarbonate-modified urethane resins and the polyether-modified urethane resins, and the at least one resin has a glass transition temperature of 20° C. or less.

6. The recording medium according to claim 1, wherein the binder further contains an ethylene-vinyl acetate copolymer.

7. The recording medium according to claim 1, wherein the inorganic particle is a wet-process silica particle.

8. The recording medium according to claim 1, wherein the ink-receiving layer contains a polyvalent metal salt.

9. The recording medium according to claim 1, wherein, for the recording medium, a total pore volume in a pore radius range of 2 nm or more and 10 nm or less is 0.2 ml/g or more.

10. The recording medium according to claim 1, wherein the inorganic particle has an oil absorption of 150 ml/100 g or more and 240 ml/100 g or less.

11. The recording medium according to claim 1, wherein the inorganic particle has a BET specific surface area of 380 $m^2/g$ or more.

12. A recording medium comprising:

a substrate; and an ink-receiving layer, wherein the ink-receiving layer contains an inorganic particle and a binder, and does not contain any water-soluble resin, the binder contains at least one component selected from the group consisting of acrylic resins, polycarbonate-modified urethane resins, and polyether-modified urethane resins, and for the recording medium, a ratio of a total pore volume in a pore radius range of 7 nm or more and 20 nm or less to a total pore volume in a pore radius range of 0 nm or more and 20 nm or less is 25% by volume or less.

13. A recording medium comprising:

a substrate; and an ink-receiving layer, wherein the ink-receiving layer contains an inorganic particle and a binder, and contains a water-soluble resin such that a ratio of a content of the water-soluble resin to a content of the binder in the ink-receiving layer is 20% by mass or less, the binder contains at least one component selected from the group consisting of acrylic resins, polycarbonate-modified urethane resins, and polyether-modified urethane resins, and for the recording medium, a ratio of a total pore volume in a pore radius range of 7 nm or more and 20 nm or less to a total pore volume in a pore radius range of 0 nm or more and 20 nm or less is 25% by volume or less.

* * * * *